US005695916A

United States Patent [19]

Fyson

[11] Patent Number: 5,695,916

[45] Date of Patent: Dec. 9, 1997

[54] PROCESSING LIQUID FOR LAMINATION PROCESSING

[75] Inventor: John Richard Fyson, Hackney, United Kingdom

[73] Assignee: Eastman Kodak Company, Rochester, N.Y.

[21] Appl. No.: 694,360

[22] Filed: Aug. 8, 1996

[30] Foreign Application Priority Data

Aug. 10, 1995 [GB] United Kingdom ..... 9513844

[51] Int. Cl.[6] ..... G03C 5/38

[52] U.S. Cl. ..... 430/403; 430/212; 430/227; 430/251; 430/404; 430/258; 430/466; 430/499

[58] Field of Search ..... 430/212, 227, 430/251, 458, 466, 403, 404, 499

[56] References Cited

U.S. PATENT DOCUMENTS

| | | | |
|---|---|---|---|
| 3,615,482 | 10/1971 | Cronig et al. | 430/466 |
| 3,944,427 | 3/1976 | Sullivan, Jr. | 106/205.01 |
| 5,422,233 | 6/1995 | Eckert et al. | 430/404 |
| 5,478,703 | 12/1995 | Simons | 430/404 |

FOREIGN PATENT DOCUMENTS

| | | |
|---|---|---|
| 1 004 333 | 3/1962 | United Kingdom . |
| 1 602 423 | 4/1977 | United Kingdom . |

*Primary Examiner*—Hoa Van Le
*Attorney, Agent, or Firm*—J. Lanny Tucker

[57] ABSTRACT

A thickened processing solution containing inert particles can be used in lamination processing to insure even processing.

12 Claims, 1 Drawing Sheet

PROCESSING LIQUID FOR LAMINATION PROCESSING

FIELD OF THE INVENTION

This invention relates to a processing liquid for lamination processing and to a method for its use.

BACKGROUND OF THE INVENTION

Lamination processing has been used in many areas of photographic processing. Essentially it comprises laminating the material to be processed with a cover sheet or processing sheet in face-to-face contact with a layer of processing liquid therebetween. When the processing is over, the two sheets are separated and the processed material is revealed.

Lamination processing can be applied to conventional black-and-white or color materials, to black-and-white or color diffusion transfer materials and to materials for redox amplification processes.

A problem with lamination processing is that it is difficult to spread the processing liquid evenly and thus uneven processing results. In particular the liquid is often squeezed out at the edges leading to incomplete processing. Also the liquid can end up in "islands" leading to patchy processing. Previously it has been proposed to include a spacer to keep the two sheets the right distance apart but this is difficult and time consuming in manufacture.

SUMMARY OF THE INVENTION

According to the present invention there is provided a thickened photographic processing solution for lamination processing comprising:

a water-soluble thickening agent, water-insoluble particles having an average diameter of from 20 to 1000 μm, and either a color developing agent or fixing agent.

There is also provided a method of lamination processing comprising laminating a material to be processed with a cover sheet or a processing sheet in face-to-face contact, there being between said material and cover sheet or processing sheet, a thickened photographic processing solution for lamination processing comprising:

a water-soluble thickening agent, water-insoluble particles having an average diameter of from 20 to 1000 μm, and either a color developing agent or fixing agent.

Even processing is obtained with the present invention without the formation of "islands". Physical damage to the photographic material is avoided when the smaller sized particles are used in the solution.

DETAILED DESCRIPTION OF THE INVENTION

Figure 1:
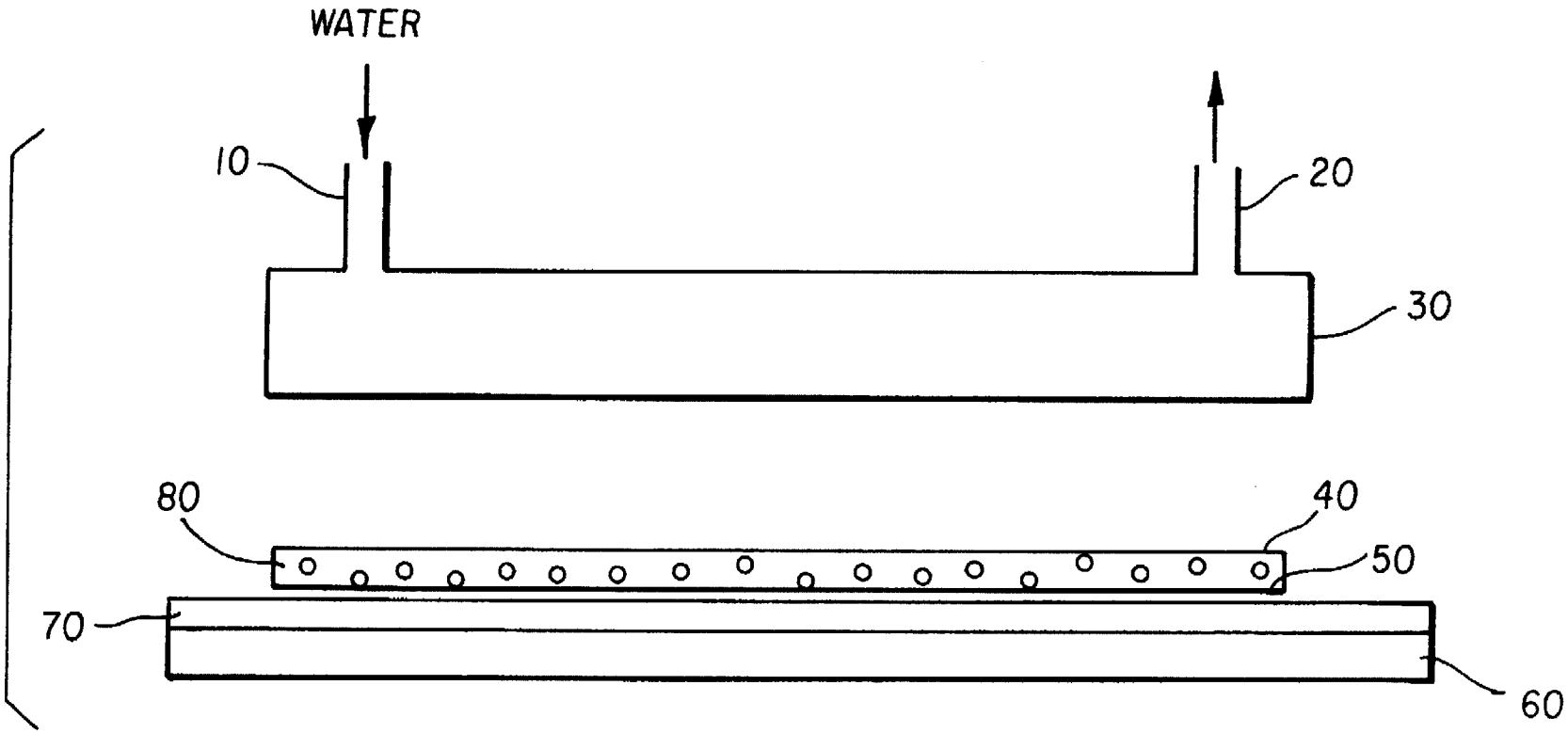
FIG. 1 of the accompanying drawings shows schematically the operation of lamination processing using a processing liquid of the present invention.

The present processing solutions preferably containing a thickening agent to increase their viscosity to a level that stops the liquid oozing out of the laminate. Such a thickener can be any water-soluble thickening agent, for example, gelatin, casein, water-soluble acrylic polymers and copolymers, water-soluble cellulose derivatives, e.g., carboxymethyl celluloses.

The processing solution may be an activator, developer, fixer or combined developer and fixer (monobath). Many such solutions are known and have been described in the literature. See for example Research Disclosure Item 36544, September 1994, published by Kenneth Mason Publications, Emsworth, Hants, United Kingdom. Section XVIII describes a wide variety of chemical processing compositions. More photographic processing solutions are described in the British Journal of Photography Annual, 1992, pages 156–164. The processing solutions may contain any of the known ingredients disclosed for this use.

The particles may be composed of glass or polymer and are preferably spherical in shape. The polymer may be an ion-exchange resin and as such may be useful in removing unwanted seasoning products from the processing liquid. Unless such an effect is desired the particles may be inert to the process taking place. The particles may have diameters in the range 20 to 1000 μm, preferably 20 to 250 μm.

In FIG. 1 a hollow stainless steel block (30) has water a controlled temperature passing through it via inlet (10) and outlet (20). A wooden block (60) is covered with an 8 mm layer of foam rubber sheet (70). On this is the photographic material being processed (50), a layer of viscous processing solution (80) containing inert beads and a plain sheet of cellulose acetate film base (40). In use the hollow block (30) is lowered on to the film 'sandwich' to maintain the desired temperature until the processing is finished whereupon the sandwich is peeled apart.

The present invention also provides method of photographic lamination processing in which one or more of the processing liquids used is a composition as described above.

The following Example is included for a better understanding of the invention.

EXAMPLE

A thickened fixer solution was made up with the following formulation:

| | |
|---|---|
| sodium thiosulfate | 210 g |
| ammonium thiosulfate | 31.5 g |
| sodium sulfite | 12 g |
| carboxymethyl cellulose | 4 g |
| Water to | 1 liter |

To this were added 2 ml Dowex 1X8 anion ion exchange resin beads (Aldrich Chemical Co.) of different sizes. These were used as they provided a ready source of beads. Once suspended in the fixer it is expected that they would quickly become saturated and act in a similar way to inert beads.

The apparatus and materials used are described with reference to FIG. 1. The hollow stainless steel block (30) has water passing through it at 30° C., to maintain process temperature. The wooden block (60) is covered with an 8 mm layer of foam rubber sheet (70). On to this is placed, emulsion side up, a length of Kodak Tmax™ 400, black and white film (50) that has previously been dipped in a 25 g/l potassium carbonate solution, to simulate the alkali of a developer and then the fixer containing beads (80) and on top of this a plain sheet of cellulose acetate film base (40). The hollow block (30) is quickly lowered on to the film 'sandwich', pressure being provided by the weight of the block filled with water—about 1 kg. After two minutes the block (30) was lifted, the 'sandwich' pulled apart, the film was washed and the extent of its fixing and evenness observed. The results are shown in the table below.

| Bead size | Fixing extent and quality |
|---|---|
| None | Fixing only in some places in islands |
| 125–500 μm (20–50 mesh) | Fixing good over the complete strip except where beads touched emulsion. Some denting of emulsion. |
| 250–500 μm (50–100 mesh) | Fixing good over the complete strip. Some denting of emulsion. |
| 125–250 μm (100–200 mesh) | Fixing good over the complete strip. No damage. |
| 62–125 μm (200–400 mesh) | Fixing good over the complete strip. No damage |

The results indicate that the beads prevented areas of uneven fixation forming. Good fixing with beads smaller than 250 μm showed no damage to the emulsion surface.

The invention has been described in detail with particular reference to preferred embodiments thereof, but it will be understood that variations and modifications can be effected within the spirit and scope of the invention.

We claim:

1. A thickened photographic processing solution for lamination processing comprising:

a water-soluble thickening agent, water-insoluble particles having an average diameter of from 20 to 1000 μm, and either a color developing agent or fixing agent.

2. The solution of claim 1 wherein said particles have an average diameter of from 20 to 250 μm.

3. The solution of claim 1 wherein said particles are composed of glass or a polymer that is inert to photographic processing conditions.

4. The solution of claim 1 wherein said particles are spherical particles.

5. The solution of claim 1 comprising a developing agent.

6. The solution of claim 1 comprising a fixing agent.

7. The solution of claim 1 wherein said thickening agent is gelatin, casein, acrylic polymer or cellulose derivative.

8. The solution of claim 7 wherein said thickening agent is carboxymethyl cellulose.

9. The solution of claim 1 wherein said particles are ion exchange resin beads.

10. A method of lamination processing comprising laminating a material to be processed with a cover sheet or a processing sheet in face-to-face contact, there being between said material and cover sheet or processing sheet, a thickened photographic processing solution for lamination processing comprising:

a water-soluble thickening agent, water-insoluble particles having an average diameter of from 20 to 1000 μm, and either a color developing agent or fixing agent.

11. The method of claim 10 wherein said solution is a developer solution comprising a developing agent.

12. The method of claim 10 wherein said solution is a fixing solution comprising a fixing agent.

* * * * *